US010870521B2

(12) United States Patent
Fang

(10) Patent No.: US 10,870,521 B2
(45) Date of Patent: Dec. 22, 2020

(54) AUTO-OPENED WATER CUP LID WITH PRESS-TYPE NOZZLE

(71) Applicant: Zikai Fang, Zhejiang (CN)

(72) Inventor: Zikai Fang, Zhejiang (CN)

( * ) Notice: Subject to any disclaimer, the term of this patent is extended or adjusted under 35 U.S.C. 154(b) by 13 days.

(21) Appl. No.: 16/264,708

(22) Filed: Feb. 1, 2019

(65) Prior Publication Data

US 2019/0161251 A1 May 30, 2019

Related U.S. Application Data

(63) Continuation of application No. PCT/CN2017/102021, filed on Sep. 18, 2017.

(30) Foreign Application Priority Data

May 5, 2017 (CN) ..... 2017 1 0329346

(51) Int. Cl.
*B65D 47/06* (2006.01)
*A47G 19/22* (2006.01)
*A45F 3/18* (2006.01)

(52) U.S. Cl.
CPC ..... *B65D 47/066* (2013.01); *A45F 3/18* (2013.01); *A47G 19/2266* (2013.01)

(58) Field of Classification Search
CPC ..... B65D 47/066; B65D 47/065; B65D 47/2043; A45F 3/20; A47G 19/2266; A47G 19/2205
See application file for complete search history.

(56) References Cited

U.S. PATENT DOCUMENTS

2012/0187075 A1 7/2012 El-Saden et al.
2015/0173539 A1* 6/2015 Mason ..... B65D 47/063 220/707

FOREIGN PATENT DOCUMENTS

CN 203058744 7/2013
CN 204015825 12/2014
(Continued)

*Primary Examiner* — Don M Anderson
(74) *Attorney, Agent, or Firm* — JCIP Global Inc.

(57) ABSTRACT

An auto-opened water cup lid with press-type nozzle includes a cup lid and a handle ring. A mounting platform is formed in the cup lid, and a perforation, an inlet hole and a button slot are formed in the mounting platform. A straw is disposed in the perforation, and the straw is provided with a nozzle. A rotating sleeve is formed in an outer sleeve of the straw. The rear end of the nozzle is in sealing contact with the front part of the rotating sleeve. A front pin and a rear pin are formed on two sides of the outer wall of the rotating sleeve, and the front pin is connected to the nozzle cover. A front pin hole and the hook slot are formed in the nozzle cover, and the front pin hole cooperates with the front pin. A rear pin hole provided on the upper inner wall of the mounting platform of the cup lid cooperates with the rear pin. The button slot is located on one side of the handle ring, and the upper end of the button slot is formed with a position-limiting hole. The spring is arranged in the button slot, and a button is arranged on one side of the button slot. The button has a pin and a pulling plate. The pin has a barb. The pin is inserted into the button slot, and the barb cooperates with the position-limiting hole. The pulling plate is provided with a hook. When the nozzle cover is closed, the hook cooperates with the hook slot on the inner wall of the nozzle cover, one side of the spring is in contact with the button slot, and the other side of the spring is in contact with the button.

4 Claims, 4 Drawing Sheets

(56) References Cited

FOREIGN PATENT DOCUMENTS

| | | |
|---|---|---|
| CN | 204071529 | 1/2015 |
| CN | 204292794 | 4/2015 |
| CN | 204318272 | 5/2015 |
| CN | 204433336 | 7/2015 |
| CN | 105683054 | 6/2016 |
| CN | 205433109 | 8/2016 |
| CN | 106974510 | 7/2017 |
| WO | 2010085367 | 7/2010 |

* cited by examiner

AUTO-OPENED WATER CUP LID WITH PRESS-TYPE NOZZLE

CROSS-REFERENCE TO RELATED APPLICATION

This application is a continuation of international PCT application Ser. No. PCT/CN2017/102021, filed on Sep. 18, 2017, which claims the priority benefit of China application No. 201710329346.X, filed on May 5, 2017. The entirety of each of the above-mentioned patent applications is hereby incorporated by reference herein and made a part of this specification.

BACKGROUND OF THE DISCLOSURE

Field of the Disclosure

The disclosure relates to a water cup lid, in particular to an auto-opened water cup lid with press-type nozzle.

Description of Related Art

Conventional water cups typically include a cup body and a cup lid. The cup body and the cup lid are screwed together, and the cup lid needs to be screwed out each time to let water out, which is troublesome to operate. Therefore, a cup lid with a straw is invented. A straw hole is provided on the cup lid, a straw is arranged in the straw hole, and a straw cover is arranged on the lid. When not in use, the straw is covered to prevent the water in the water cup from pouring out through the straw, and the straw cover covers the straw to avoid impurities such as dust from adhering to the drinking part of the straw. However, each time when the structure is used for drinking water, the straw cover needs to be flipped open by hand, and then the straw is raised to allow people to drink the water, and thus there is still some inconvenience.

SUMMARY OF THE DISCLOSURE

The purpose of the disclosure is to overcome the shortcomings of the related art, and to provide an auto-opened water cup lid with press-type nozzle of which the nozzle and the nozzle cover can be automatically opened by pressing a button, and the opening direction of the nozzle is opposite to the handle direction, which is convenient to operate and facilitates users to drink water.

The technical solution of the auto-opened water cup lid with press-type nozzle is characterized in including a cup lid and a handle ring formed on one side of the cup lid. A mounting platform is formed in the cup lid, and a perforation, an inlet hole and a button slot are formed in the mounting platform. A straw made of soft rubber material is disposed in the perforation, and the straw is provided with a nozzle. A rotating sleeve made of a hard plastic material is formed in an outer sleeve of the straw. The rear end of the nozzle is in sealing contact with the front part of the rotating sleeve. A front pin and a rear pin are formed on two sides of the outer wall of the rotating sleeve, and the front pin is connected to the nozzle cover. A front pin hole and the hook slot are formed in the nozzle cover, and the front pin hole cooperates with the front pin. A rear pin hole is provided on the upper inner wall of the mounting platform of the cup lid, and the rear pin hole cooperates with the rear pin. The button slot is located on one side of the handle ring, and the upper end of the button slot is formed with a position-limiting hole. The spring is arranged in the button slot, and a button is arranged on one side of the button slot. The button has a pin and a pulling plate. The pin has a barb. The pin is inserted into the button slot, and the barb cooperates with the position-limiting hole. The pulling plate is provided with a hook. When the nozzle cover is closed, the hook cooperates with the hook slot on an inner wall of the nozzle cover, one side of the spring is in contact with the button slot, and the other side of the spring is in contact with the button.

The disclosure discloses an auto-opened water cup lid with press-type nozzle. When in use, the button is pressed with a finger, the button presses the spring inward, and the button simultaneously drives the pin and the pulling plate to move inward. The pin drives the barb to move inward along the position-limiting hole. The pulling plate drives the hook to move inward. The hook on the pulling plate is disengaged inwardly from the hook slot on the inner wall of the nozzle cover. On this occasion, the bent straw drives the nozzle to rebound upward by the restoring force. The nozzle drives the rotating sleeve to rotate upward around the rear pin. The rotating sleeve drives the nozzle cover to rotate upward such that the nozzle and the nozzle cover are opened, and the user can drink the water in the water cup through the nozzle. When not in use, the nozzle cover and the nozzle are pressed back with fingers such that the nozzle cover, the nozzle and the rotating sleeve are rotated downward around the rear pin. When the hook slot of the nozzle cover contacts the hook of the button, the finger presses lightly to make the hook to be engaged in the hook slot. The spring pushes the button outward under the effect of the restoring force, and the button drives the pulling plate to move outward. The pulling plate drives the hook to move outward, so that the hook can be hooked to the hook slot to prevent the nozzle cover from being easily opened. In the auto-opened water cup lid with press-type nozzle proposed in the solution, one feature is that the hook on the button cooperates with the hook slot of the nozzle cover, and the nozzle cover is connected to the straw through the rotating sleeve. When the hook is disengaged from the hook slot, the resilient force of the straw drives the nozzle, the rotating sleeve and the nozzle cover to be opened automatically. The nozzle can be opened by simply pressing the button, which is easy to operate and convenient for user to drink water. Another feature is that the button is disposed on one side of the handle ring and highly invisible, which allows for beautiful appearance. The head of the nozzle faces the button and is opposite to the handle direction after being opened, thereby preventing the handle ring from blocking the nozzle and thus being easy for user to drink water.

In the auto-opened water cup lid with press-type nozzle of the disclosure, the straw is provided a retaining ring, and the retaining ring is limitedly in contact with the lower end of the perforation. The retaining ring limits the position of the straw so that the straw is not pulled out during closing and opening. A bump is formed under the nozzle. The bump contacts the inlet hole when the nozzle is closed downward. When not in use, the nozzle is closed downward, and the bump on the nozzle presses the inlet hole to reduce emission of heat, and can prevent water from pouring out from the inlet hole. When the nozzle is rotated upward and the user drinks water with the nozzle, the air can enter from the inlet hole to avoid negative pressure from being generated in the cup due to sucking of water. The upper outer wall of the cup lid is provided with a soft rubber layer, which provides a good sense of touch and is easy for user to hold.

DESCRIPTION OF EMBODIMENTS

Figure 1:
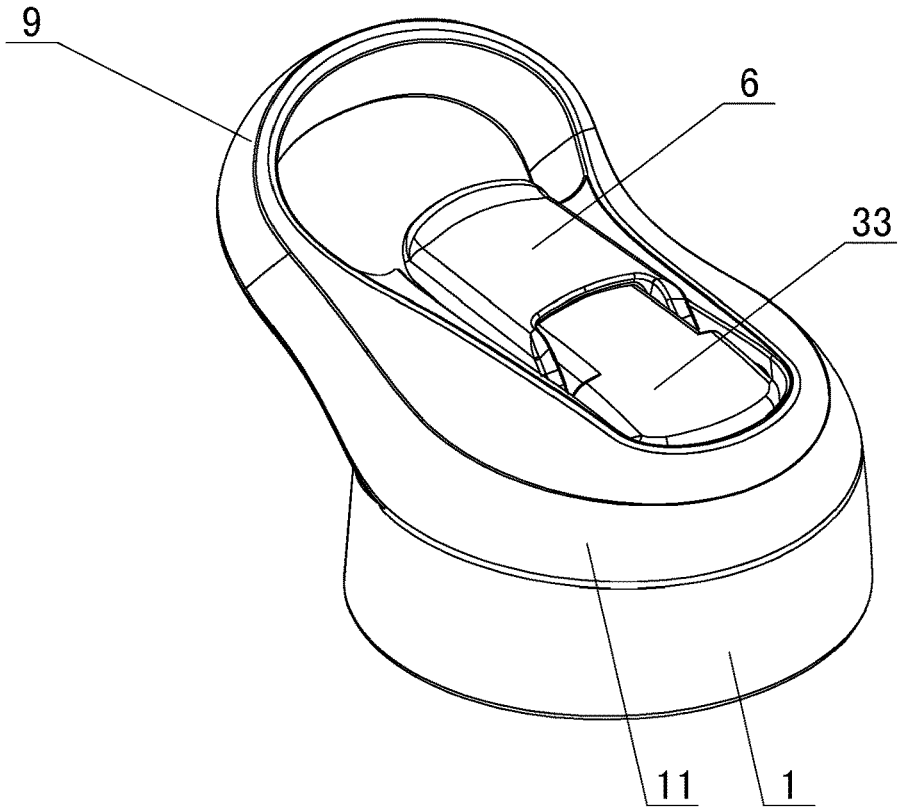
FIG. 1 is a schematic perspective view of an auto-opened water cup lid with press-type nozzle of the disclosure.
Figure 2:
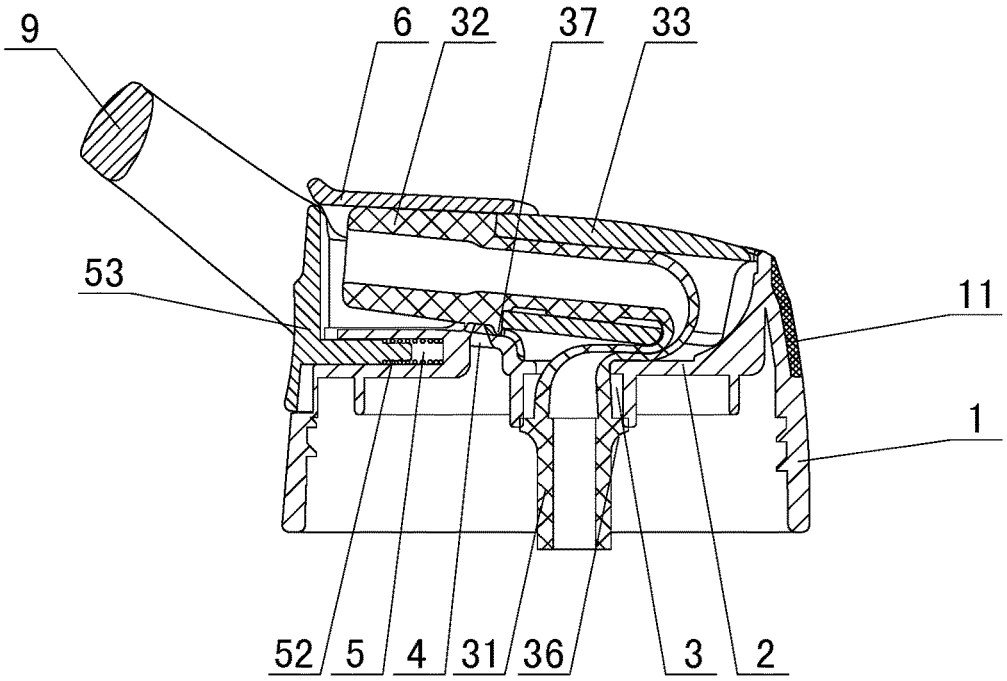
FIG. 2 is a schematic view of a structure of the auto-opened water cup lid with press-type nozzle of the disclosure.
Figure 3:
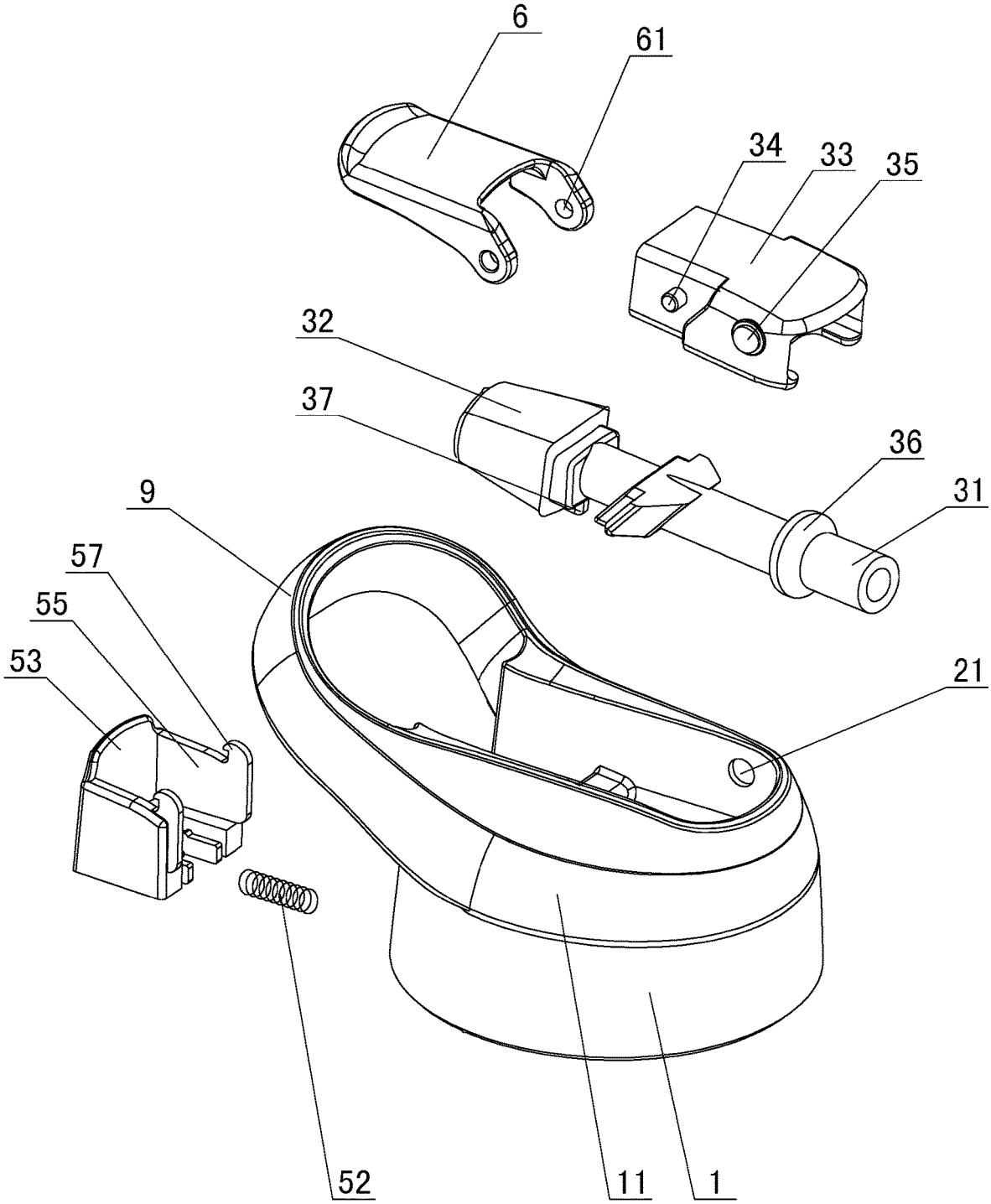
FIG. 3 is a schematic perspective view of an exploded state of the auto-opened water cup lid with press-type nozzle of the disclosure.
Figure 4:
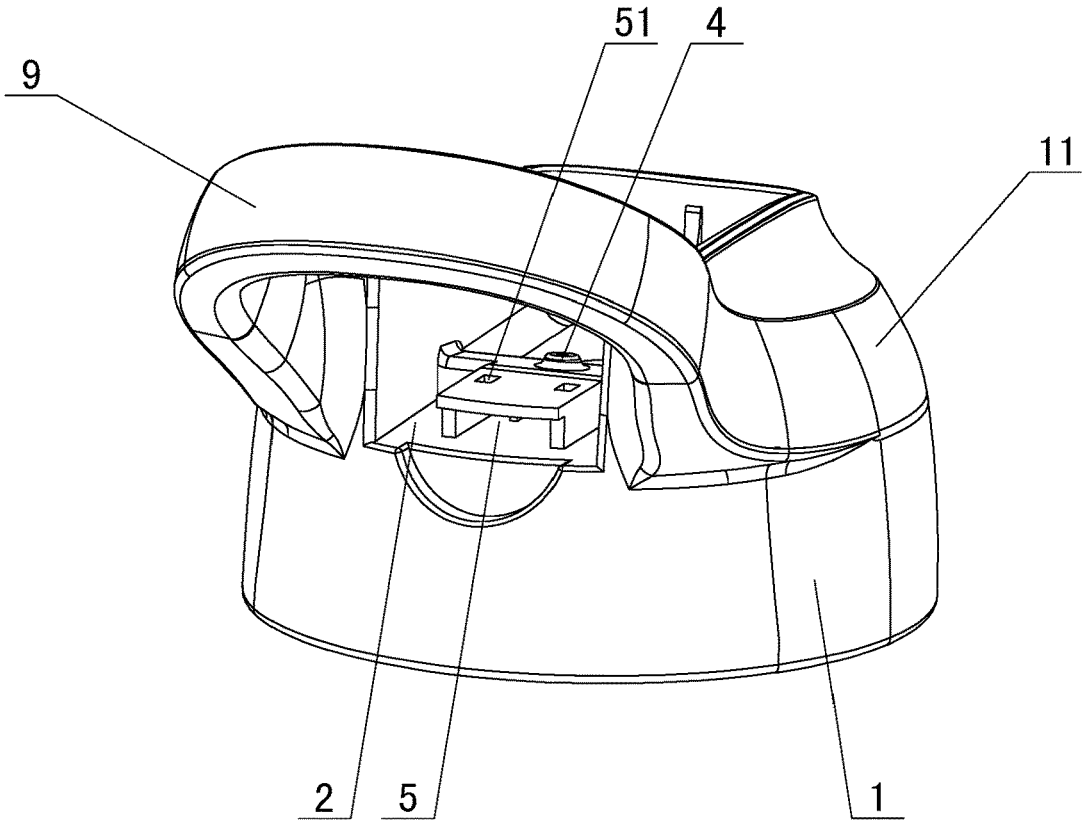
FIG. 4 is a schematic perspective view of a cup lid.
Figure 5:
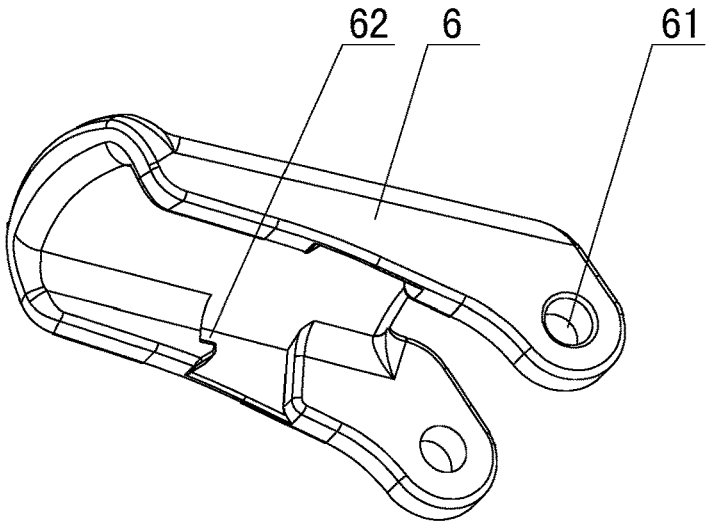
FIG. 5 is a schematic perspective view of a nozzle cover.
Figure 6:
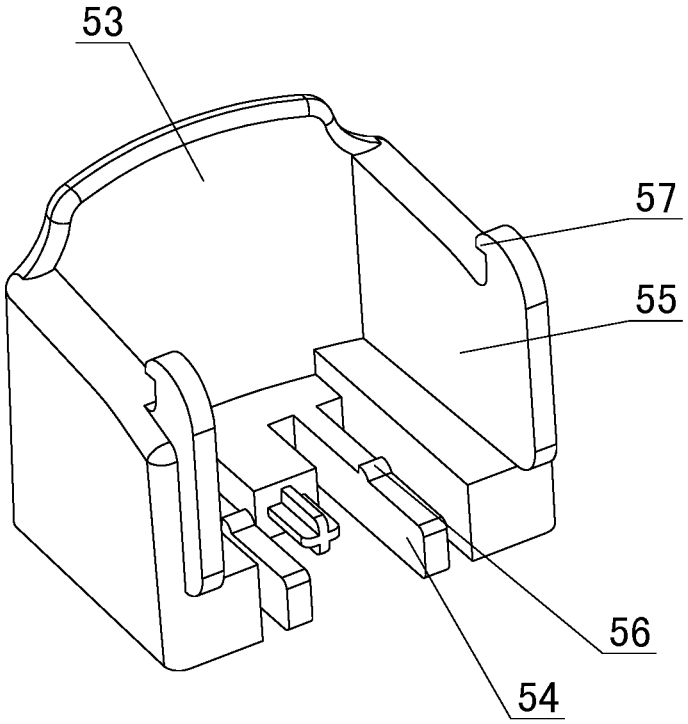
FIG. 6 is a schematic perspective view of a button.

The disclosure relates to an auto-opened water cup lid with press-type nozzle as shown in FIG. 1 to FIG. 6, characterized in including a cup lid 1 and a handle ring 9 formed on one side of the cup lid. The cup lid is provided with a mounting platform 2 therein, and the mounting platform has a perforation 3, an inlet hole 4 and a button slot 5. A straw 31 made of a soft rubber material is arranged in the perforation 3, and a nozzle 32 is formed on the straw. A rotating sleeve 33 formed of hard plastic material is formed on an outer sleeve of the straw. The rear end of the nozzle is in sealing contact with the front portion of the rotating sleeve, and a front pin 34 and a rear pin 35 are formed on both sides of the outer wall of the rotating sleeve. The front pin is connected to the nozzle cover 6, and the nozzle cover is provided with a front pint hole 61 and a hook slot 62 therein. The front pin hole cooperates with the front pin 34. The rear pin hole 21 is formed on the upper inner wall on the mounting platform 2 of the cup lid 1, and the rear pin hole and the rear pin 35 cooperate with each other. The button slot 5 is located on one side of the handle ring 9, and the upper end of the button slot is provided with a position-limiting hole 51. A spring 52 is arranged in the button slot, and a button 53 is provided on one side of the button slot. The button is provided with a pin 54 and a pulling plate 55. The pin is provided with a barb 56. The pin is inserted into the button slot 5. The barb cooperates with the position-limiting hole 51, and the pulling plate is provided with a hook 57. When the nozzle cover 6 is closed, the hook 57 and the hook slot 62 on the inner wall of the nozzle cover 6 cooperate with each other. One side of the spring 52 is in contact with the button slot 5, and the other side of the spring is in contact with the button 53. When in use, the button 53 is pressed with a finger, the button presses the spring 52 inward, and the button simultaneously drives the pin 54 and the pulling plate 55 to move inward. The pin drives the barb 56 to move inward along the position-limiting hole 51. The pulling plate drives the hook 57 to move inward. The hook on the pulling plate is disengaged inwardly from the hook slot 62 on the inner wall of the nozzle cover 6. On this occasion, the bent straw 31 drives the nozzle 32 to rebound upward by the restoring force. The nozzle drives the rotating sleeve 33 to rotate upward around the rear pin 35. The rotating sleeve drives the nozzle cover 6 to rotate upward such that the nozzle 32 and the nozzle cover 6 are opened, and the user can drink the water in the water cup through the nozzle. When not in use, the nozzle cover 6 and the nozzle 32 are pressed back with fingers such that the nozzle cover, the nozzle and the rotating sleeve 33 are rotated downward around the rear pin 35. When the hook slot 62 of the nozzle cover 6 contacts the hook 57 of the button 53, the finger presses lightly to make the hook to be engaged in the hook slot. The spring 52 pushes the button 53 outward under the effect of the restoring force, and the button drives the pulling plate 55 to move outward. The pulling plate drives the hook 57 to move outward, so that the hook can be hooked to the hook slot 62 to prevent the nozzle cover 6 from being easily opened. In the auto-opened water cup lid with press-type nozzle proposed in the solution, one feature is that the hook 57 on the button 53 cooperates with the hook slot 62 of the nozzle cover 6, and the nozzle cover is connected to the straw 31 through the rotating sleeve 33. When the hook 57 is disengaged from the hook slot 62, the resilient force of the straw 31 drives the nozzle 32, the rotating sleeve 33 and the nozzle cover 6 to be opened automatically. The nozzle 32 can be opened by simply pressing the button 53, which is easy to operate and convenient for user to drink water. Another feature is that the button 53 is disposed on one side of the handle ring 9 and highly invisible, which allows for beautiful appearance. The head of the nozzle 32 faces the button and is opposite to the handle direction after being opened, thereby preventing the handle ring from blocking the nozzle and thus being easy for user to drinkwater. The straw 31 is provided a retaining ring 36, and the retaining ring passes through the perforation 3. The retaining ring is limitedly in contact with the lower end of the perforation. The retaining ring 36 limits the position of the straw 31 so that the straw 31 is not pulled out during closing and opening. A bump 37 is formed under the nozzle 32. The bump contacts the inlet hole 4 when the nozzle is closed downward. When not in use, the nozzle 32 is closed downward, and the bump 37 on the nozzle presses the inlet hole 4 to reduce emission of heat, and can prevent water from pouring out from the inlet hole. When the nozzle 32 is rotated upward and the user drinks water with the nozzle, the air can enter from the inlet hole to avoid negative pressure from being generated in the cup due to sucking of water. The upper outer wall of the cup lid 1 is provided with a soft rubber layer 11, which provides a good sense of touch and is easy for user to hold.

What is claimed is:

1. An auto-opened water cup lid with press-type nozzle, comprising:

a cup lid;

a handle ring formed on one side of the cup lid;

a mounting platform formed in the cup lid, and the mounting platform being provided with a perforation, an inlet hole and a button slot, wherein the button slot is located on the cup lid, and a position-limiting hole is provided on an upper end of the button slot;

a straw made of soft rubber material arranged in the perforation;

a nozzle formed on the straw;

a rotating sleeve made of a hard plastic material formed on an outer sleeve of the straw, wherein a rear end of the nozzle is in sealing contact with a front portion of the rotating sleeve, and each of two opposite sidewalls of the rotating sleeve is provided with a front pin and a rear pin;

a nozzle cover connected to the front pin, wherein the nozzle cover is provided with a front pin hole and a hook slot, and the front pin hole cooperates with the front pin, and wherein a rear pin hole is provided on an upper inner wall of the mounting platform of the cup lid and the rear pin hole cooperates with the rear pin;

a spring provided in the button slot; and a button arranged on one side of the button slot, and the button having a pin and a pulling plate, wherein the pin is inserted into the button slot, a barb is provided on the pin, the barb cooperates with the position-limiting hole, and the pulling plate is provided with a hook, and wherein when the nozzle cover is closed, the hook cooperates with the hook slot on an inner wall of the nozzle cover, one side of the spring is in contact with the button slot, and an opposite side of the spring is in contact with the button.

2. The auto-opened water cup lid with press-type nozzle according to claim 1, wherein the straw is provided with a retaining ring, and the retaining ring is interfered with a lower end of the perforation.

3. The auto-opened water cup lid with press-type nozzle according to claim 1, wherein a bump is provided under the nozzle, and when the nozzle is closed downward, the bump is in contact with the inlet hole.

4. The auto-opened water cup lid with press-type nozzle according to claim 1, wherein a soft rubber layer is provided on an upper outer wall of the cup lid.

* * * * *